US009284169B2

(12) United States Patent
Nishimoto

(10) Patent No.: US 9,284,169 B2
(45) Date of Patent: Mar. 15, 2016

(54) SAILBOAT WINCH

(71) Applicant: Shimano Inc., Sakai, Osaka (JP)

(72) Inventor: Naohiro Nishimoto, Osaka (JP)

(73) Assignee: Shimano Inc., Osaka (JP)

( * ) Notice: Subject to any disclaimer, the term of this patent is extended or adjusted under 35 U.S.C. 154(b) by 37 days.

(21) Appl. No.: 14/163,204

(22) Filed: Jan. 24, 2014

(65) Prior Publication Data

US 2015/0210517 A1 Jul. 30, 2015

(51) Int. Cl.

*B66D 1/14* (2006.01)
*B66D 1/22* (2006.01)
*B66D 1/74* (2006.01)

(52) U.S. Cl.

CPC ..... *B66D 1/22* (2013.01); *B66D 1/7431* (2013.01); *B66D 1/7484* (2013.01)

(58) Field of Classification Search

CPC ..... B66D 1/22; B66D 1/225; B66D 1/24; B66D 1/7431; B66D 1/7484; B66D 2700/0183; F16H 2001/2881; F16H 2001/289; F16H 3/003; F16H 3/44; F16H 2003/007; F16H 2003/442

USPC ..... 254/342, 345, 346, 352, 353, 355–357

See application file for complete search history.

(56) References Cited

U.S. PATENT DOCUMENTS 3,712,155 A 1/1973 Stommel et al.
3,927,580 A * 12/1975 Fawcett ..... 74/810.1
3,962,935 A * 6/1976 Hutton et al. ..... 74/810.1
3,973,755 A * 8/1976 Fawcett ..... 254/354
3,981,208 A * 9/1976 Moses ..... 74/810.1
3,998,431 A * 12/1976 Fawcett ..... 254/343
4,054,266 A 10/1977 Guangorena
4,161,126 A * 7/1979 Winzeler ..... 475/83
4,736,929 A * 4/1988 McMorris ..... 254/344
5,368,279 A * 11/1994 Ottemann et al. ..... 254/342
5,370,366 A * 12/1994 Ottemann ..... 254/343
5,398,637 A * 3/1995 Chambers ..... 114/343
5,927,691 A * 7/1999 Ottemann ..... 254/344
6,029,952 A * 2/2000 Huggett et al. ..... 254/344
7,789,375 B2 * 9/2010 Ying ..... 254/344
2013/0119329 A1 5/2013 Fields et al.
2013/0119330 A1 5/2013 Fields et al.
2013/0313495 A1 11/2013 Chenon et al.

OTHER PUBLICATIONS

European Search Report of corresponding EP Application No. 14 19 7386.6 dated Jun. 11, 2015.

* cited by examiner

*Primary Examiner* — Emmanuel M Marcelo
(74) *Attorney, Agent, or Firm* — Global IP Counselors

(57) ABSTRACT

A sailboat winch basically includes a support, a winch drum, a drive shaft and a transmission mechanism. The support is mounted to a sailboat. The winch drum is rotatable with respect to the support. The drive shaft is rotatable with respect to the support and the winch drum. The transmission mechanism is operatively disposed between the drive shaft and the winch drum to transmit rotation from the drive shaft to the winch drum in a single output rotational direction. The transmission mechanism increases an output rotational speed of the winch drum with respect to an input rotational speed of the drive shaft as the drive shaft rotates in a first rotational direction. The transmission mechanism also decreases the output rotational speed of the winch drum with respect to the input rotational speed of the drive shaft as the drive shaft rotates in a second rotational direction.

5 Claims, 6 Drawing Sheets

SAILBOAT WINCH

BACKGROUND

1. Field of the Invention

This invention generally relates to a sailboat winch. More specifically, the present invention relates to a sailboat winch for a sailboat.

2. Background Information

Sailboat winches are conventionally well known that are utilized in maneuvering sails on a sailboat. The conventional sailboat winches are used for adjusting the tension of lines or ropes of the sailboat. These lines are also called a jib or spinnaker sheet, for example. Each of the lines has a loaded end that is connected to a sail and an unloaded end or tail that is collected in a cockpit of the sailboat by the sailboat winch.

When loading a sailboat winch with the line, the line is manually drawn and wound onto the winch drum to temporarily apply the tension to the line. Then, for example, a winch handle is attached to the sailboat winch, and then the winch handle is manually turned to rotate the winch drum until desired tension of the line is obtained.

SUMMARY

Generally, the conventional sailboat winches have a reduction gear mechanism operatively coupled to the winch drum for easily winding the lines even under heavy loads. However, in this conventional construction, manually winding the line onto the winch drum takes a long time to obtain suitable load by winding using the winch handle and the reduction gear mechanism. This makes it difficult to promptly obtain the desired tension of the line.

One aspect is to provide a sailboat winch with which desired tension of a line can be promptly obtained. Another aspect is to provide a sailboat winch with which the workload for manually drawing the line to temporarily apply the tension can be reduced.

In view of the state of the known technology and in accordance with a first aspect of the present invention, a sailboat winch comprises a support, a winch drum, a drive shaft, and a transmission mechanism. The support is configured to be mounted to a sailboat. The winch drum is rotatable with respect to the support. The drive shaft is rotatable with respect to the support and the winch drum. The transmission mechanism is operatively disposed between the drive shaft and the winch drum to transmit rotation from the drive shaft to the winch drum in a single output rotational direction. The transmission mechanism is configured to increase an output rotational speed of the winch drum with respect to an input rotational speed of the drive shaft as the drive shaft rotates in a first rotational direction. The transmission mechanism is further configured to decrease the output rotational speed of the winch drum with respect to the input rotational speed of the drive shaft as the drive shaft rotates in a second rotational direction, which is opposite the first rotational direction.

In accordance with a second aspect of the present invention, the sailboat winch according to the first aspect is configured so that the transmission mechanism includes a first gear set, a second gear set, and an output gear set. The first gear set having a first planetary gear and a first one-way clutch. The second gear set having a second planetary gear and a second one-way clutch. The output gear set is operatively coupled to the first and second planetary gears via the first and second one-way clutches, respectively.

In accordance with a third aspect of the present invention, the sailboat winch according to the second aspect is configured so that the first gear set and the output gear set are arranged to establish a first torque transmission path between the drive shaft and the winch drum as the drive shaft rotates in the first rotational direction, and so that the second gear set and the output gear set are arranged to establish a second torque transmission path between the drive shaft and the winch drum as the drive shaft rotates in the second rotational direction.

In accordance with a fourth aspect of the present invention, the sailboat winch according to the first aspect is configured so that the winch drum and the drive shaft are concentrically arranged relative to each other.

In accordance with a fifth aspect of the present invention, the sailboat winch according to the fourth aspect is configured so that the first rotational direction of the drive shaft is opposite the output rotational direction of the winch drum.

In accordance with a sixth aspect of the present invention, the sailboat winch according to the first aspect is configured so that the drive shaft has a crank attachment structure that is configured to receive a crank handle for manual rotation of the drive shaft.

Also other objects, features, aspects and advantages of the disclosed sailboat winch will become apparent to those skilled in the art from the following detailed description, which, taken in conjunction with the annexed drawings, discloses one embodiment of the sailboat winch.

BRIEF DESCRIPTION OF THE DRAWINGS

Referring now to the attached drawings which form a part of this original disclosure.

DETAILED DESCRIPTION OF EMBODIMENTS

A selected embodiment will now be explained with reference to the drawings. It will be apparent to those skilled in the art from this disclosure that the following descriptions of the embodiment are provided for illustration only and not for the purpose of limiting the invention as defined by the appended claims and their equivalents.

Figure 1:
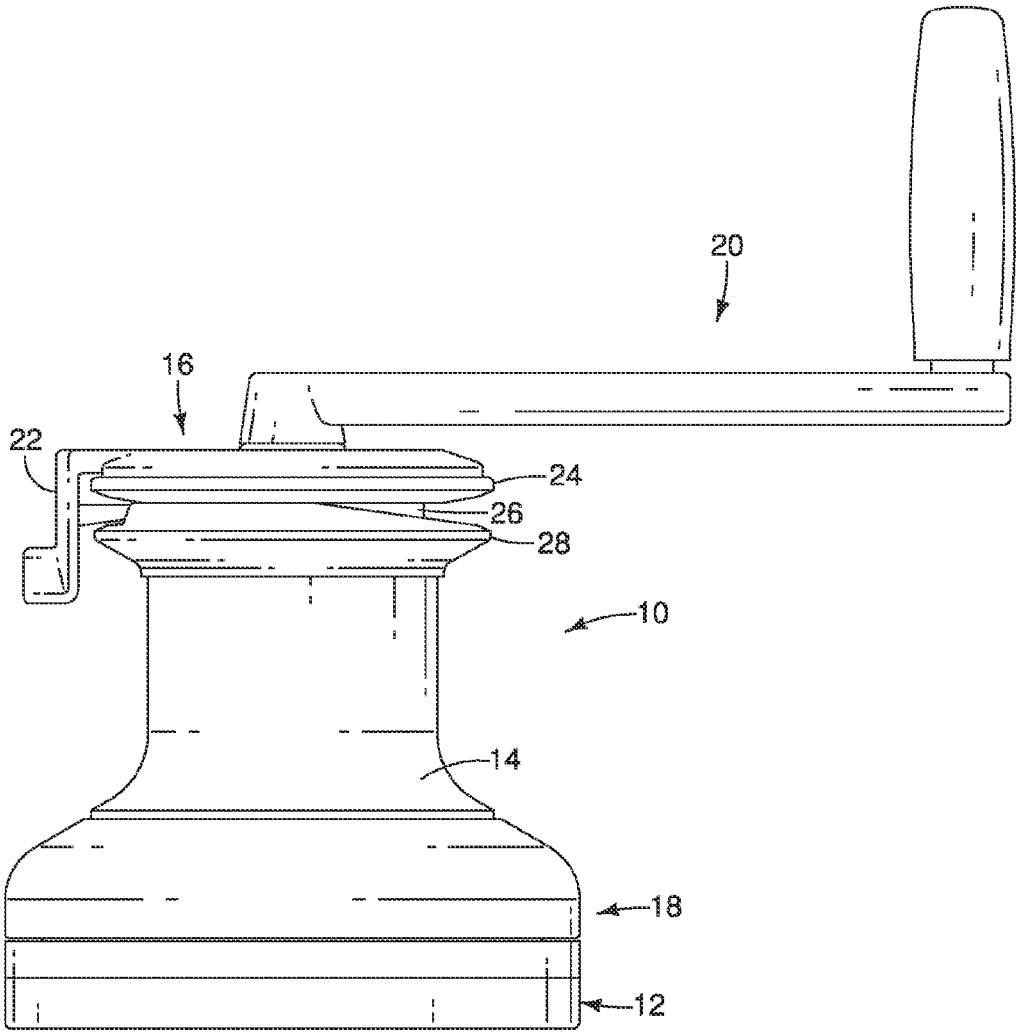
FIG. 1 is a side elevational view of a sailboat winch in accordance with one embodiment, illustrating a winch handle being attached to the sailboat winch.

Referring initially to FIG. 1, a sailboat winch 10 is illustrated in accordance with one embodiment. The sailboat winch 10 is typically installed on a deck of a sailboat (not shown) for maneuvering a sail on the sailboat. Specifically, the sailboat winch 10 is used for adjusting the tension of a line or rope of the sailboat. The line has a loaded end or tail that is connected to the sail and an unloaded end or tail that is collected in a hull (not shown) of the sailboat by the sailboat winch 10.

Figure 2A:
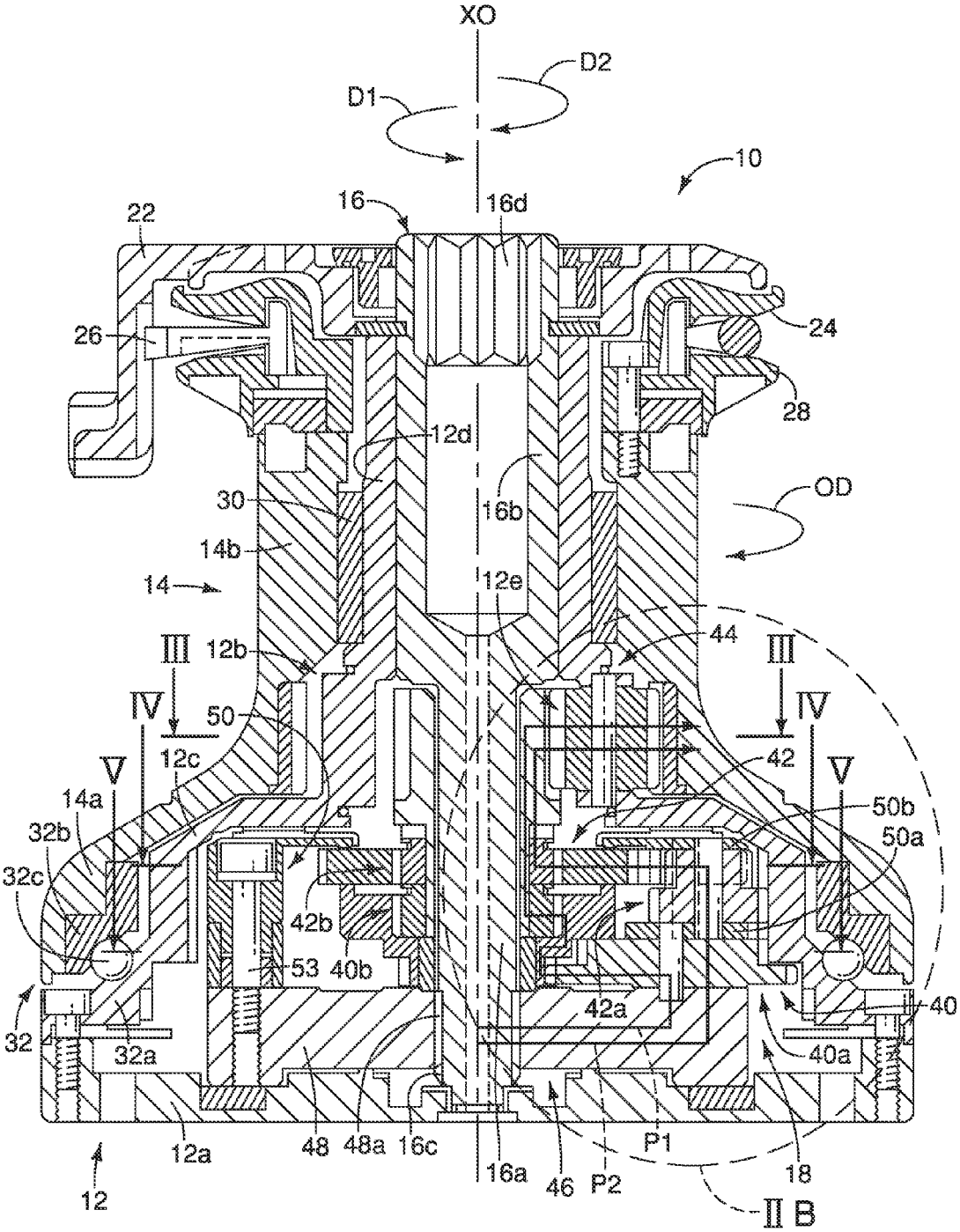
FIG. 2A is a cross sectional view of the sailboat winch illustrated in FIG. 1.

As shown in FIGS. 1 and 2A, the sailboat winch 10 basically comprises a base or support 12, a winch drum 14, a spindle or drive shaft 16, and a transmission mechanism 18.

The support 12 is basically configured to be mounted to a hull of a sailboat (not shown). The winch drum 14 is rotatable with respect to the support 12. The drive shaft 16 is rotatable with respect to the support 12 and the winch drum 14. The transmission mechanism 18 is operatively disposed between the drive shaft 16 and the winch drum 14 to transmit rotation from the drive shaft 16 to the winch drum 14 in a single output rotational direction OD. With the sailboat winch 10, the winch drum 14 rotates in the single output rotational direction OD with different rotational speeds according to rotational operations of the drive shaft 16 in a first rotational direction D1 and a second rotational direction D2. The winch drum 14 draws the line placed thereon to adjust the tension of the line. In the illustrated embodiment, a winch handle 20 (e.g., a crank handle) is detachably attached to an upper part of the drive shaft 16 for manual rotation of the drive shaft 16, which also rotates the winch drum 14 via the transmission mechanism 18. Since the winch handle 20 are well known in the art, detailed configuration of the winch handle 20 will be omitted for the sake of brevity. In the illustrated embodiment, while the sailboat winch 10 is illustrated as being manually operated by the winch handle 20, it will be apparent to those skilled in the art from this disclosure that the present invention can be operated in a different manner, such as using an electric or hydraulic motor.

As shown in FIGS. 1 and 2A, in the illustrated embodiment, the sailboat winch 10 is the so-called self-tailing winch. Specifically, as shown in FIGS. 1 and 2A, the sailboat winch 10 further includes a self-tailing arrangement having a feeder arm 22, an upper crown 24, a stripper ring 26, and a lower crown 28. The self-tailing arrangement is located at the upper end of the sailboat winch 10. With the self-tailing arrangement, the upper and lower crowns 24 and 28 have a line gripping feature, and are biased towards each other by springs (not shown) to allow a range of line diameters to fit into the channel defined between the upper and lower crowns 24 and 28. The feeder arm 22 guides the line from the winch drum 14 into the channel between the upper and lower crowns 24 and 28. The feeder arm 22 is fixed with respect to the sailboat winch 10 such that the feeder arm 22 does not rotate with the winch drum 14 or the upper and lower crowns 24 and 28. The line passes along the channel between the upper and lower crowns 24 and 28, and then the line exits the channel at an unloaded end of the line adjacent to the feeder arm 22 by being guided out of the channel between the upper and lower crowns 24 and 28 by the stripper ring 26. Since these parts of the self-tailing arrangement are well known in the art, these parts will not be discussed or illustrated in detail herein, except as they are modified to be used in conjunction with the present invention. Moreover, various conventional sailboat winch parts, which are not illustrated and/or discussed herein, can be used in conjunction with the present invention. In the illustrated embodiment, while the sailboat winch 10 is illustrated as a self-tailing winch, it will be apparent to those skilled in the art from this disclosure that the present invention can be applied to other types of winch such as a standard winch without a self-tailing arrangement.

As mentioned above, the support 12 is mounted to the sailboat. In particular, the support 12 is fixedly coupled to the deck of the hull in a conventional manner, such as screws. The support 12 is made of a metallic material conventionally used for a support or base of sailboat winches. As shown in FIG. 2A, the support 12 has a lower case 12*a* and an upper case 12*b*. In the illustrated embodiment, the lower case 12*a* and the upper case 12*b* are independently formed as separate members, and are fixedly coupled to each other by screws or adhesive. The lower case 12*a* and the upper case 12*b* define an internal space therebetween in which the transmission mechanism 18 is accommodated. The lower case 12*a* is basically a disk-shaped member. The upper case 12*b* has a transmission housing 12*c* and a center stem 12*d*. The transmission housing 12*c* has an outer periphery that corresponds to an inner periphery of the winch drum 14. The center stem 12*d* is basically formed as a cylindrical member that axially extends from the top part of the transmission housing 12*c*. The center stem 12*d* has a center axis that defines a rotational axis X0 of the sailboat winch 10.

As shown in FIG. 2A, the winch drum 14 is radially outwardly disposed relative to the upper case 12*b* of the support 12 and the drive shaft 16. The winch drum 14 has a lower part 14*a* and an upper part 14*b* having a smaller diameter than the lower part 14*a*. The winch drum 14 is similar to the conventional winch drum. Thus, the detailed description of the external configuration of the winch drum 14 will be omitted for the sake of brevity. In the illustrated embodiment, the winch drum 14 is integrally formed as a one-piece, unitary member. The winch drum 14 is made of a metallic material conventionally used for a winch drum of sailboat winches.

As mentioned above, the winch drum 14 is rotatable with respect to the support 12. In particular, the winch drum 14 is rotatable with respect to the support 12 about the rotational axis X0 of the sailboat winch 10. The winch drum 14 is rotatably supported with respect to the upper case 12*b* of the support 12 by a roller bearing 30 and a ball bearing 32. The roller bearing 30 is radially disposed between the center stem 12*d* of the support 12 and the upper part 14*b* of the winch drum 14. The ball bearing 32 is disposed between the transmission housing 12*c* of the support 12 and the lower part 14*a* of the winch drum 14. In particular, as shown in FIG. 2A, the ball bearing 32 has an inner race 32*a*, an outer race 32*b* and a plurality of rollers or balls 32*c*. The inner race 32*a* is integrally formed on the outer periphery of the transmission housing 12*c* of the upper case 12*b*. Of course, alternatively, the inner race 32*a* can be formed as a separate part from the upper case 12*b*. The outer race 32*b* is basically a ring-shaped member, and is fixedly coupled to the inner periphery of the lower part 14*a* of the winch drum 14. The balls 32*c* are disposed between the inner race 32*a* and the outer race 32*b* to support radial loads and thrust or axial loads between the support 12 and the winch drum 14. Since the roller bearing 30 and the ball bearing 32 are well known in the art, the detailed configuration of the roller bearing 30 and the ball bearing 32 will be omitted for the sake of brevity.

As shown in FIG. 2A, the drive shaft 16 is arranged such that the drive shaft 16 axially extends through the upper case 12*b* of the support 12 and the winch drum 14. Specifically, the drive shaft 16 is basically an elongated member. The drive shaft 16 basically has a lower part 16*a* and an upper part 16*b*. The lower part 16*a* has a smaller diameter than the upper part 16*b*. The lower part 16*a* of the drive shaft 16 has serrated teeth 16*c* on the outer periphery of the lower part 16*a* at one end of the drive shaft 16. The upper part 16*b* of the drive shaft 16 has a socket 16*d* (e.g., a crank attachment structure) at the other end of the drive shaft 16. The socket 16*d* has serrated teeth on the inner periphery of the socket 16*d* that are configured to mesh with serrated teeth on the outer periphery of a drive axle of the winch handle 20 while the socket 16*d* receives the winch handle 20 therewithin. Thus, in other words, in the illustrated embodiment, the drive shaft 16 has the socket (e.g., the crank attachment structure) that is configured to receive the winch handle 20 (e.g., the crank handle) for manual rotation of the drive shaft 16. In particular, in the illustrated embodiment, the winch handle 20 is detachably attached to the socket 16*d* with the serration coupling such that the winch handle 20 and the drive shaft 16 integrally rotate about the rotational axis X0. The drive shaft 16 is made of a metallic material conventionally used for a drive shaft or spindle of sailboat winches.

The winch drum 14 and the drive shaft 16 are concentrically arranged relative to each other with respect to the rotational axis X0. As illustrated in FIG. 2A, the drive shaft 16 is rotatably supported by a plain bearing defined by the inner peripheral surface of the center stem 12*d* and the outer peripheral surface of the upper part 16*b*. In particular, the drive shaft 16 is rotatably attached the center stem 12*d* such that the outer peripheral surface of the upper part 16*b* is slidable over the inner peripheral surface of the center stem 12*d*. In the illustrated embodiment, the upper part 16*b* of the drive shaft 16 has an outer diameter that is equal to or slightly smaller than an inner diameter of the center stem 12*d*. Thus, the drive shaft 16 is rotatably supported by the support 12 without radial play.

Figure 2B:
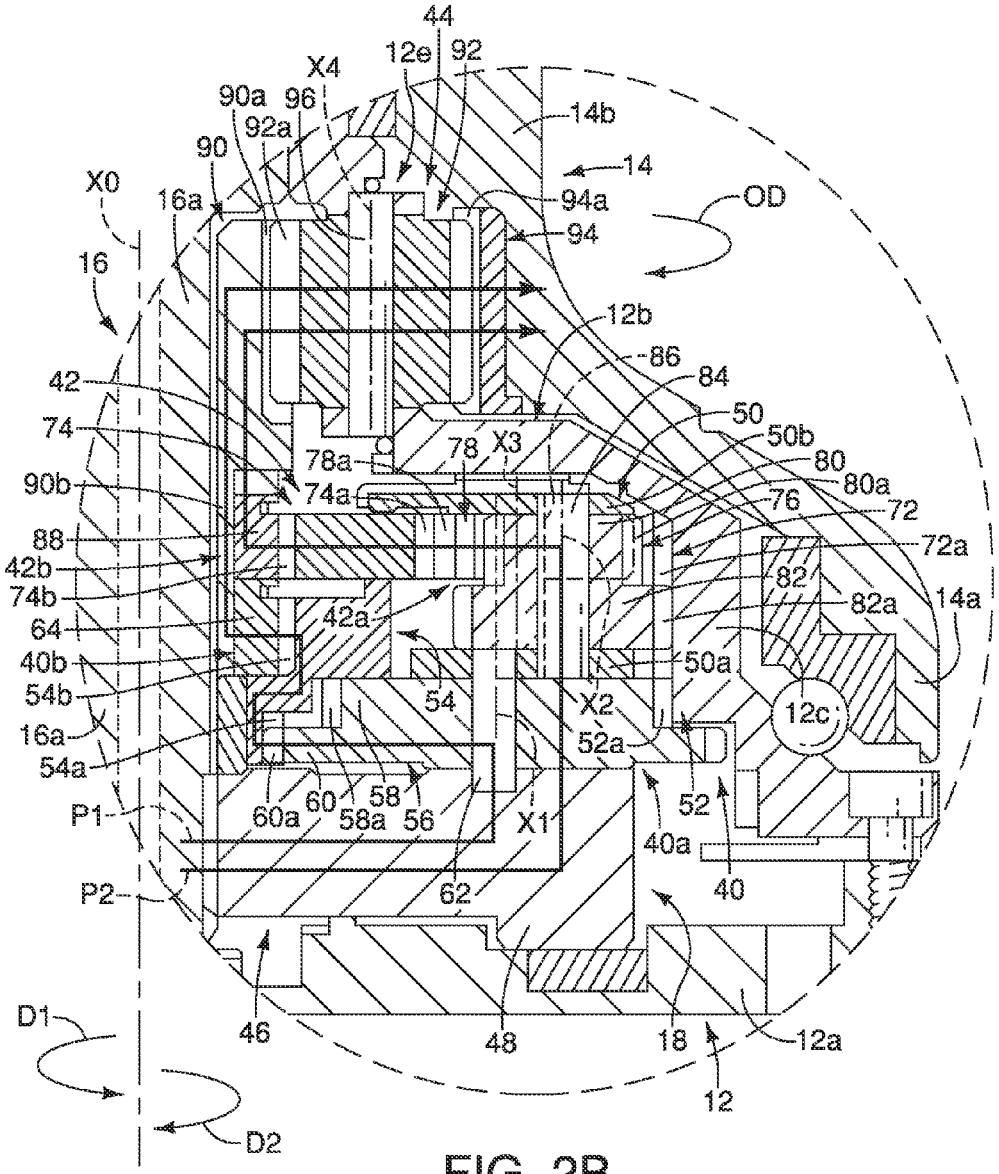
FIG. 2B is an enlarged, cross sectional view of the sailboat winch illustrated in FIG. 1, illustrating an encircled portion IIB in FIG. 2A.

The transmission mechanism 18 is disposed within the internal space of the support 12. As shown in FIGS. 2A and 2B, the transmission mechanism 18 includes a first gear set 40, a second gear set 42 and an output gear set 44. The first gear set 40 has a first planetary gear 40*a* and a first one-way clutch 40*b*. The second gear set 42 has a second planetary gear 42*a* and a second one-way clutch 42*b*. The output gear set 44 is operatively coupled to the first and second planetary gears 40*a* and 42*a* via the first and second one-way clutches 40*b* and 42*b*, respectively. In the illustrated embodiment, the first gear set 40 transmit rotation of the drive shaft 16 (or the winch handle 20) in the first rotational direction D1 about the rotational axis X0 to the winch drum 14 via the output gear set 44 to rotate the winch drum 14 in the single output rotational direction OD. On the other hand, the second gear set 42 transmit rotation of the drive shaft 16 in the second rotational direction D2 about the rotational axis X0 to the winch drum 14 via the output gear set 44 to rotate the winch drum 14 in the single output rotational direction OD. As shown in FIG. 2A, the first rotational direction D1 of the drive shaft 16 corresponds to the counterclockwise direction as axially viewed from above about the rotational axis X0, while the second rotational direction D2 of the drive shaft 16 corresponds to the clockwise direction as axially viewed from above about the rotational axis X0. Also, the single output rotational direction OD of the winch drum 14 corresponds to the clockwise direction as axially viewed from above about the rotational axis X0. In other words, the first rotational direction D1 of the drive shaft 16 is opposite the single output rotational direction OD of the winch drum 14. Of course, it will be apparent to those skilled in the art from this disclosure that the relations between the rotational directions of the drive shaft 16 and the winch drum 14 can be differently configured as desired and/or needed by changing the configurations of the transmission mechanism 18 (e.g., the first gear set 40, the second gear set 42, and the output gear set 44). For example, the transmission mechanism 18 can be configured such that the first and second rotational directions of the drive shaft 16 correspond to the clockwise and counterclockwise directions, respectively. Furthermore, the transmission mechanism 18 can also be configured such that the single output rotational direction of the winch drum 14 corresponds to the first rotational direction D1 (the counterclockwise direction).

Furthermore, the transmission mechanism 18 includes a gear carrier 46. In the illustrated embodiment, the gear carrier 46 includes a rotary base 48 and a gear case 50. The rotary base 48 and the gear case 50 are fixedly coupled to each other by a plurality of (three, for example) screws 53 (only one screw 53 is shown in FIG. 2A) at circumferentially equidistantly spaced apart locations about the rotational axis X0. As shown in FIG. 2A, the rotary base 48 has serrated teeth 48*a* on the inner periphery of a center through hole of the rotary base 48. The serrated teeth 48*a* of the rotary base 48 mesh with the serrated teeth 16*c* of the drive shaft 16, thereby fixedly and non-rotatably coupling the rotary base 48 to the drive shaft 16. Thus, the rotary base 48 and the gear case 50 fixedly coupled to the rotary base 48 integrally rotates with the drive shaft 16 about the rotational axis X0 while the drive shaft 16 rotates about the rotational axis X0. The gear case 50 has a lower stage 50*a* and an upper stage 50*b*. The lower stage 50*a* is axially disposed between the upper stage 50*b* and the rotary base 48. In the illustrated embodiment, as shown in FIGS. 2A and 2B, the first planetary gear 40*a* of the first gear set 40 is axially disposed between the lower stage 50*a* and the rotary base 48, while the second planetary gear 42*a* of the second gear set 42 is axially disposed between the upper stage 50*b* and the lower stage 50*a*.

Figure 5:
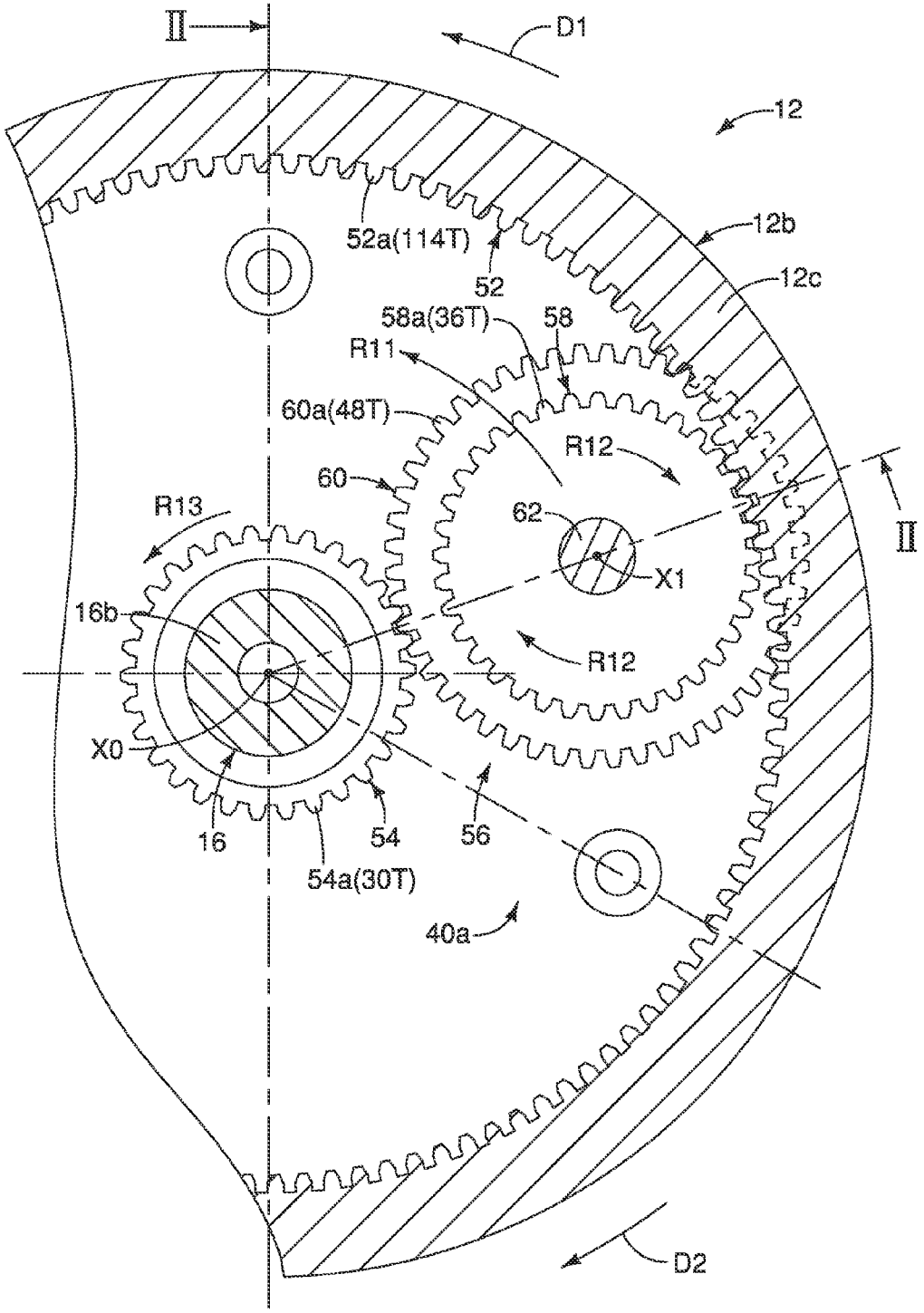
FIG. 5 is a schematic cross sectional view of the sailboat winch illustrated in FIG. 1, taken along V-V line in FIG. 2A.

Referring now to FIGS. 2B and 5, the first gear set 40 will be further described in detail. As shown in FIGS. 2B and 5, the first planetary gear 40*a* basically includes a ring gear 52, a ratchet gear 54, and a plurality of (three, for example) planet gears 56 (only one is shown in FIGS. 2B and 5). These gears 52, 54 and 56 are made of a metallic material conventionally used for gears of sailboat winches.

The ring gear 52 has internal gear teeth 52*a* that are integrally formed about the inner periphery of the transmission housing 12*c* of the upper case 12*b* of the support 12. In the illustrated embodiment, the teeth number of the ring gear 52 is 114 T. In the illustrated embodiment, the ring gear 52 is integrally formed with the support 12. However, it will be apparent to those skilled in the art from this disclosure that the ring gear 52 can be formed as a separate part from the support 12 and fixedly coupled to the inner periphery of the support 12 by a press-fit or any other suitable fixing manner.

The ratchet gear 54 has external gear teeth 54*a* and internal ratchet teeth 54*b*. The ratchet gear 54 is integrally formed as a one-piece, unitary member. The external gear teeth 54*a* are formed about the outer periphery of a lower part of the ratchet gear 54, while the internal ratchet teeth 54*b* are formed about the inner periphery of an upper part of the ratchet gear 54. In other words, the external gear teeth 54*a* and the internal ratchet teeth 54*b* are axially spaced apart from each other. In the illustrated embodiment, the external gear teeth 54*a* is radially inwardly disposed relative to the internal ratchet teeth 54*b*. However, the external gear teeth 54*a* can be radially outwardly disposed relative to the internal ratchet teeth 54*b*. In the illustrated embodiment, the teeth number of the external gear teeth 54*a* of the ratchet gear 54 is 30 T. The ratchet gear 54 is rotatably mounted on the lower part 16*a* of the drive shaft 16 via a roller bearing or other bearing means. Specifically, in the illustrated embodiment, the ratchet gear 54 is concentrically arranged relative to the drive shaft 16 with respect to the rotational axis X0.

Each of the planet gears 56 is formed as a stepped gear with a small diameter gear 58 and a large diameter gear 60. In the illustrated embodiment, the small diameter gear 58 and the large diameter gear 60 are concentrically arranged with respect to each other, and are integrally formed as a one-piece, unitary member. However, it will be apparent to those skilled in the art from this disclosure that the small diameter gear 58 and the large diameter gear 60 can be formed as separate parts that are fixedly coupled to each other. The planet gears 56 are rotatably mounted on support axles 62, respectively. In the illustrated embodiment, as shown in FIG. 2B, the support axles 62 have center axes X1, respectively, that extend parallel to the rotational axis X0, respectively. Thus, the planet gears 56 are rotatable about the center axes X1 of the support axles 62, respectively. In the illustrated embodiment, three support axles 62 (only one is shown in FIG. 2B) are located at circumferentially equidistantly spaced apart locations about the rotational axis X0. As shown in FIG. 2B, each of the support axles 62 axially extends between the rotary base 48 and the lower stage 50*a*, and is fixedly coupled to the rotary base 48 and the lower stage 50*a* at both axial ends. Thus, the planet gears 56 are revolvable about the rotational axis X0. In particular, the planet gears 56 supported on the support axles 62 revolve about the rotational axis X0 while the rotary base 48 and the lower stage 50*a* rotates about the rotational axis X0.

As shown in FIGS. 2B and 5, the small diameter gear 58 has external gear teeth 58*a*, while the large diameter gear 60 has external gear teeth 60*a*. In the illustrated embodiment, the teeth number of the small diameter gear 58 is 36 T, while the teeth number of the large diameter gear 60 is 48 T. As shown in FIG. 5, the external gear teeth 58*a* of the small diameter gear 58 mesh with the internal gear teeth 52*a* of the ring gear 52. On the other hand, the external gear teeth 60*a* of the large diameter gear 60 mesh with the external gear teeth 54*a* of the ratchet gear 54.

In the illustrated embodiment, the first gear set 40 has three planet gears 56. However, the number of the planet gears 56 and numbers of any other planet gears described in this description are provided for illustration only, and can be different as needed and/or desired. Also, in the illustrated embodiment, with the first gear set 40, the teeth numbers of the internal gear teeth 52*a*, the external gear teeth 54*a*, the external gear teeth 58*a*, and the external gear teeth 60*a* are 114 T, 30 T, 36 T, and 48 T, respectively. However, these teeth numbers and teeth numbers of any other gears or ratchets described in this description are provided for illustration only, and can be different as needed and/or desired. Furthermore, in the illustrated embodiment, the module of the gears 52, 54 and 56 (i.e., 58 and 60) is "1.0," for example. However, this module and any other modules described in this description are provided for illustration only, and can be different as needed and/or desired.

The first one-way clutch 40*b* is operatively disposed between the first planetary gear 40*a* and the output gear set 44. In particular, in the illustrated embodiment, the first one-way clutch 40*b* is configured such that the first one-way clutch 40*b* only transmits rotation of the ratchet gear 54 in the counterclockwise direction as axially viewed from above about the rotational axis X0 to the output gear set 44. As shown in FIG. 2B, the first one-way clutch 40*b* has a plurality of (two, for example) clutch pawls 64. The clutch pawls 64 are pivotally arranged about the outer periphery of an output sleeve 90 (described later) of the output gear set 44. Specifically, the clutch pawls 64 are pivotally coupled to the output sleeve 90 of the output gear set 44 in a conventional manner such that the clutch pawls 64 pivot between a release position and an engagement position. The clutch pawls 64 are spring biased towards the engagement position such that the clutch pawls 64 engage with the internal ratchet teeth 54*b* of the ratchet gear 54 to transmit the rotation of the ratchet gear 54 to the output sleeve 90 of the output gear set 44 while the ratchet gear 54 rotates in the counterclockwise direction about the rotational axis X0. On the other hand, the clutch pawls 64 disengage from the internal ratchet teeth 54*b* of the ratchet gear 54 to allow relative rotation of the ratchet gear 54 relative to the output sleeve 90 of the output gear set 44 while the ratchet gear 54 rotates in the clockwise direction about the rotational axis X0. Since the configuration of the first one-way clutch 40*b* is well known in the art, the detailed description of the first one-way clutch 40*b* will be omitted for the sake of brevity. In the illustrated embodiment, while the first one-way clutch 40*b* is illustrated as having the clutch pawls 64, it will be apparent to those skilled in the art from this disclosure that the first one-way clutch 40*b* can be other types of one-way clutch such as a roller clutch.

Figure 4:
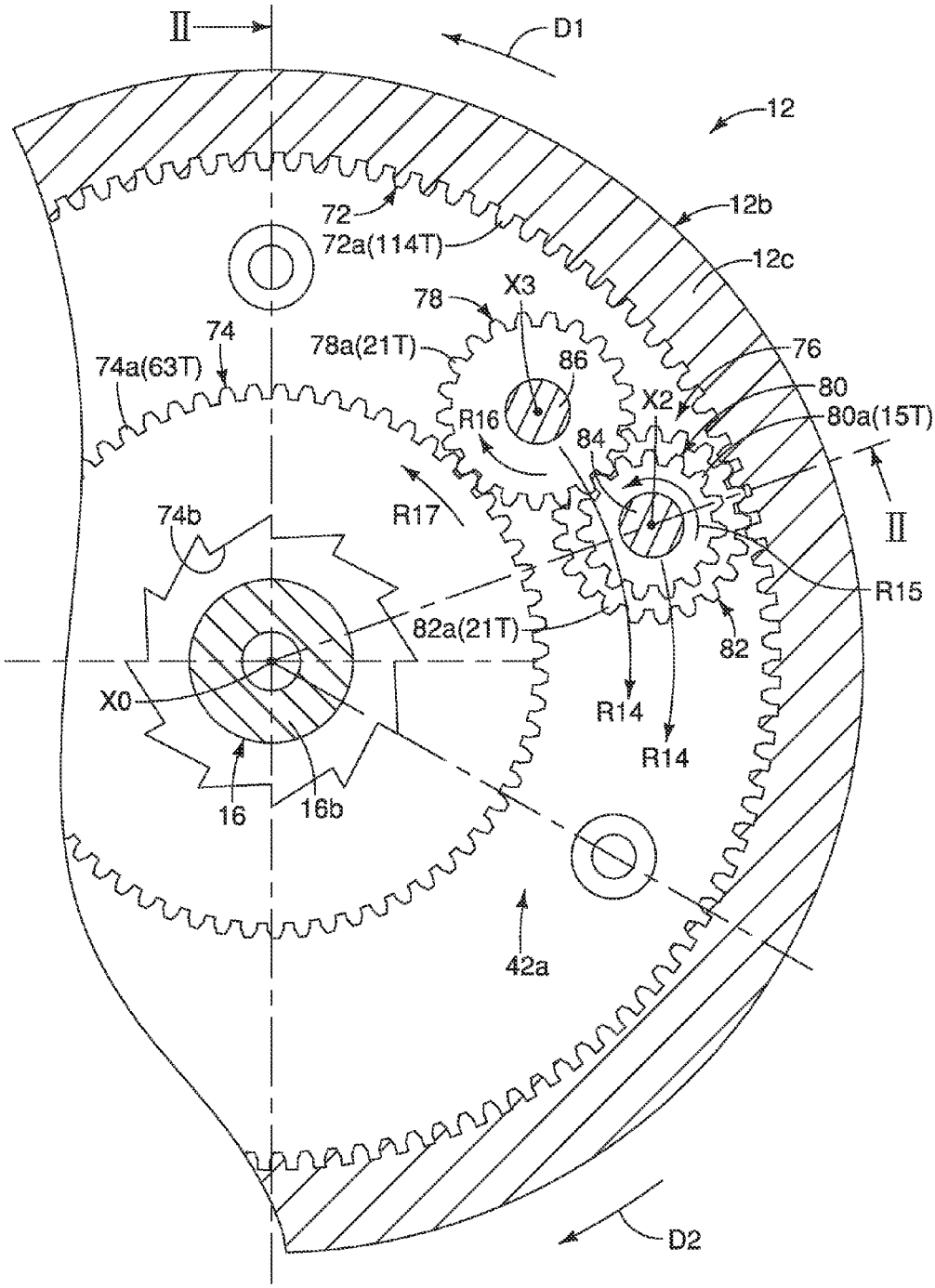
FIG. 4 is a schematic cross sectional view of the sailboat winch illustrated in FIG. 1, taken along IV-IV line in FIG. 2A.

Referring now to FIGS. 2B and 4, the second gear set 42 will be further described in detail. As shown in FIGS. 2B and 4, the second planetary gear 42*a* basically includes a ring gear 72, a ratchet gear 74, a plurality of (three, for example) outer planet gears 76 (only one is shown in FIGS. 2B and 4), and a plurality of (three, for example) inner planet gears 78. These gears 72, 74, 76 and 78 are made of a metallic material conventionally used for gears of sailboat winches.

The ring gear 72 has internal gear teeth 72*a* that are integrally formed about the inner periphery of the transmission housing 12*c* of the upper case 12*b* of the support 12. In the illustrated embodiment, the teeth number of the ring gear 72 is 114 T. In the illustrated embodiment, the ring gear 72 is integrally formed with the support 12. Specifically, the ring gear 72 is integrally formed with the ring gear 52 as a single gear formed about the inner periphery of the transmission housing 12*c* of the upper case 12*b* of the support 12. In other words, in the illustrated embodiment, an axially lower portion of the single gear forms the ring gear 52, while an axially upper portion of the single gear forms the ring gear 72. Thus, the ring gears 52 and 72 have the same inner diameter. However, it will be apparent to those skilled in the art from this disclosure that the ring gear 72 can be formed as a separate part from the support 12 and fixedly coupled to the inner periphery of the support 12 by a press-fit or any other suitable fixing manner.

The ratchet gear 74 has external gear teeth 74*a* and internal ratchet teeth 74*b*. The ratchet gear 74 is integrally formed as a one-piece, unitary member. The external gear teeth 74*a* are formed about the outer periphery of the ratchet gear 74, while the internal ratchet teeth 74*b* are formed about the inner periphery of the ratchet gear 74. In other words, the external gear teeth 74*a* and the internal ratchet teeth 74*b* are aligned with respect to each other as viewed in a direction perpendicular to the rotational axis X0. In the illustrated embodiment, the external gear teeth 74*a* is radially outwardly disposed relative to the internal ratchet teeth 74*b*. In the illustrated embodiment, the teeth number of the external gear teeth 74*a* of the ratchet gear 74 is 63 T. The ratchet gear 74 is rotatably mounted on the lower part 16*a* of the drive shaft 16 via the second one-way clutch 42*b*. Specifically, in the illustrated embodiment, the ratchet gear 74 is concentrically arranged relative to the drive shaft 16 with respect to the rotational axis X0.

Each of the outer planet gears 76 is formed as a stepped gear with a small diameter gear 80 and a large diameter gear 82. In the illustrated embodiment, the small diameter gear 80 and the large diameter gear 82 are concentrically arranged with respect to each other, and are integrally formed as a one-piece, unitary member. However, it will be apparent to those skilled in the art from this disclosure that the small diameter gear 80 and the large diameter gear 82 can be formed as separate parts that are fixedly coupled to each other. The outer planet gears 76 are rotatably mounted on support axles 84, respectively. In the illustrated embodiment, as shown in FIG. 2B, the support axles 84 have center axes X2, respectively, which extend parallel to the rotational axis X0, respectively. Thus, the outer planet gears 76 are rotatable about the center axes X2 of the support axles 84, respectively. In the illustrated embodiment, three support axles 84 (only one is shown in FIG. 2B) are located at circumferentially equidistantly spaced apart locations about the rotational axis X0. As shown in FIG. 2B, each of the support axles 84 axially extends between the lower stage 50*a* and the upper stage 50*b*, and is fixedly coupled to the lower stage 50*a* and the upper stage 50*b* at both axial ends. Thus, the outer planet gears 76 are revolvable about the rotational axis X0. In particular, the outer planet gears 76 supported on the support axles 84 revolve about the rotational axis X0 while the lower stage 50*a* and the upper stage 50*b* rotates about the rotational axis X0.

As shown in FIGS. 2B and 4, the small diameter gear 80 has external gear teeth 80*a*, while the large diameter gear 82 has external gear teeth 82*a*. In the illustrated embodiment, the teeth number of the small diameter gear 80 is 15 T, while the teeth number of the large diameter gear 82 is 21 T. As shown in FIG. 4, the external gear teeth 80*a* of the small diameter gear 80 mesh with external gear teeth 78*a* of respective one of the inner planet gears 78. On the other hand, the external gear teeth 82*a* of the large diameter gear 82 mesh with the internal gear teeth 72*a* of the ring gear 72.

Each of the inner planet gears 78 is formed as a spur gear with the external gear teeth 78*a*. In the illustrated embodiment, each of the inner planet gears 78 is integrally formed as a one-piece, unitary member. The inner planet gears 78 are rotatably mounted on support axles 86, respectively. In the illustrated embodiment, as shown in FIG. 2B, the support axles 86 have center axes X3, respectively, that extend parallel to the rotational axis X0, respectively. Thus, the inner planet gears 78 are rotatable about the center axes X3 of the support axles 86, respectively. In the illustrated embodiment, three support axles 86 (only one is shown in FIG. 2B with dotted lines) are located at circumferentially equidistantly spaced apart locations about the rotational axis X0. Furthermore, as shown in FIGS. 2B and 4, in the illustrated embodiment, the center axes X3 of the support axles 86 are radially inwardly located with respect to the center axes X2 of the support axles 84, respectively. Also, the center axes X3 of the support axles 86 are radially outwardly located with respect to the center axes X1 of the support axles 62, respectively. Furthermore, as shown in FIG. 4, the center axes X3 of the support axles 86 are circumferentially offset with respect to the center axes X2 of the support axles 84, respectively. As shown in FIG. 2B, each of the support axles 86 axially extends between the lower stage 50*a* and the upper stage 50*b*, and is fixedly coupled to the lower stage 50*a* and the upper stage 50*b* at both axial ends. Thus, the inner planet gears 78 are revolvable about the rotational axis X0. In particular, the inner planet gears 78 supported on the support axles 86 revolve about the rotational axis X0 while the lower stage 50*a* and the upper stage 50*b* rotates about the rotational axis X0.

As shown in FIGS. 2B and 4, in the illustrated embodiment, the teeth number of each of the inner planet gears 78 is 21 T. As shown in FIG. 4, the external gear teeth 78*a* of each of the inner planet gears 78 mesh with external gear teeth 80*a* of the small diameter gear 80 of respective one of the outer planet gears 76. Furthermore, the external gear teeth 78*a* of each of the inner planet gears 78 mesh with the external gear teeth 74*a* of the ratchet gear 74.

In the illustrated embodiment, the second gear set 42 has three outer planet gears 76 and three inner planet gears 78. Also, in the illustrated embodiment, with the second gear set 42, the teeth numbers of the internal gear teeth 72*a*, the external gear teeth 74*a*, the external gear teeth 78*a*, the external gear teeth 80*a*, and the external gear teeth 82*a* are 114 T, 63 T, 21 T, 15 T, and 21 T, respectively. Furthermore, in the illustrated embodiment, the module of the gears 72, 74, 76 (i.e., 80 and 82), and 78 is "1.0," for example.

The second one-way clutch 42*b* is operatively disposed between the second planetary gear 42*a* and the output gear set 44. In particular, in the illustrated embodiment, the second one-way clutch 42*b* is configured such that the second one-way clutch 42*b* only transmits rotation of the ratchet gear 74 in the counterclockwise direction as axially viewed from above about the rotational axis X0 to the output gear set 44. As shown in FIG. 2B, the second one-way clutch 42*b* has a plurality of (two, for example) clutch pawls 88. The clutch pawls 88 are pivotally arranged about the outer periphery of the output sleeve 90 (described later) of the output gear set 44. Specifically, the clutch pawls 88 are pivotally coupled to the output sleeve 90 of the output gear set 44 in a conventional manner such that the clutch pawls 88 pivot between a release position and an engagement position. The clutch pawls 88 are spring biased towards the engagement position such that the clutch pawls 88 engage with the internal ratchet teeth 74*b* of the ratchet gear 74 to transmit the rotation of the ratchet gear 74 to the output sleeve 90 of the output gear set 44 while the ratchet gear 74 rotates in the counterclockwise direction about the rotational axis X0. On the other hand, the clutch pawls 88 disengage from the internal ratchet teeth 74*b* of the ratchet gear 74 to allow relative rotation of the ratchet gear 74 relative to the output sleeve 90 of the output gear set 44 while the ratchet gear 74 rotates in the clockwise direction about the rotational axis X0. Since the configuration of the second one-way clutch 42*b* is well known in the art, the detailed description of the second one-way clutch 42*b* will be omitted for the sake of brevity. In the illustrated embodiment, while the second one-way clutch 42*b* is illustrated as having the clutch pawls 88, it will be apparent to those skilled in the art from this disclosure that the second one-way clutch 42*b* can be other types of one-way clutch such as a roller clutch.

Figure 3:
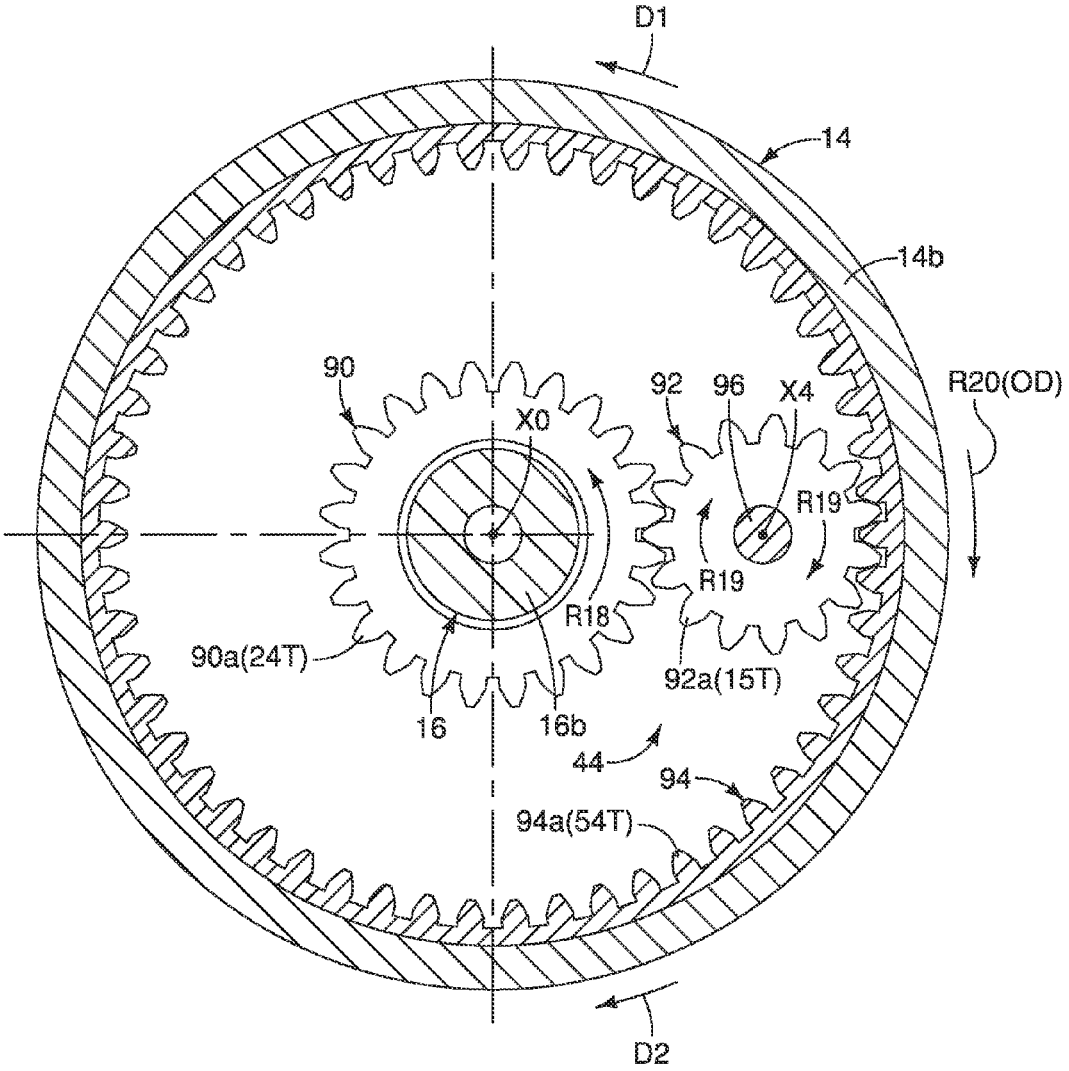
FIG. 3 is a schematic cross sectional view of the sailboat winch illustrated in FIG. 1, taken along III-III line in FIG. 2A.

Referring now to FIGS. 2B and 3, the output gear set 44 will be further described in detail. As shown in FIGS. 2B and 3, the output gear set 44 basically includes the output sleeve 90, an intermediate gear 92, and a ring gear 94. The output sleeve 90, the intermediate gear 92, and the ring gear 94 are made of a metallic material conventionally used for parts or gears of sailboat winches.

The output sleeve 90 is basically an elongated cylindrical member. The output sleeve 90 is rotatably mounted on the lower part 16*a* of the drive shaft 16. Specifically, the output sleeve 90 is concentrically arranged relative to the drive shaft 16 with respect to the rotational axis X0. Thus, the output sleeve 90 is rotatable relative to the drive shaft 16 about the rotational axis X0. The output sleeve 90 has external gear teeth 90*a* at an upper end portion thereof and a pawl support 90*b* at a lower end portion thereof. In the illustrated embodiment, the number of teeth of the external gear teeth 90*a* is 24 T. The pawl support 90*b* pivotally supports the clutch pawls 64 and 88 in a conventional manner. Specifically, in the illustrated embodiment, the pawl support 90*b* supports the clutch pawls 64 and 88 such that the clutch pawls 64 and 88 are aligned with respect to each other as axially viewed.

The intermediate gear 92 is radially disposed between the output sleeve 90 and the ring gear 94. The intermediate gear 92 is formed as a spur gear with external gear teeth 92*a*. The intermediate gear 92 is rotatably mounted on a support axle 96, respectively. In the illustrated embodiment, as shown in FIG. 2B, the support axle 96 has a center axis X4 that extends parallel to the rotational axis X0. Thus, the intermediate gear 92 is rotatable about the center axis X4 of the support axle 96. As shown in FIG. 2B, in the illustrated embodiment, the center axis X4 of the support axle 96 is radially inwardly located with respect to the center axes X1, X2 and X3 of the support axles 62, 84 and 86. As shown in FIG. 2B, both ends of the support axle 96 are fixedly supported by the transmission housing 12*c* of the upper case 12*b* of the support 12. Specifically, the transmission housing 12*c* has an access opening 12*e* that radially communicates between inside and outside of the transmission housing 12*c*. The both ends of the support axle 96 are supported by the edges of the access opening 12*e*, respectively, such that the intermediate gear 92 is disposed through the access opening 12*e* to radially inwardly engage with the external gear teeth 90*a* of the output sleeve 90, and to radially inwardly engage with the ring gear 94. Since the support 12 is stationary while the drive shaft 16 rotates about the rotational axis X0, the intermediate gear 92 is not revolvable about the rotational axis X0. In the illustrated embodiment, the teeth number of the intermediate gear 92 is 15 T. As shown in FIG. 3, the external gear teeth 92*a* mesh with the external gear teeth 90*a* of the output sleeve 90, while the external gear teeth 92*a* mesh with the ring gear 94.

The ring gear 94 is basically a ring-shaped member with internal gear teeth 94*a*. The ring gear 94 is fixedly coupled to the inner periphery of the upper part 14*b* of the winch drum 14 by a press-fit or any other suitable fixing manner. In the illustrated embodiment, the teeth number of the ring gear 94 is 54 T. As shown in FIG. 3, the internal gear teeth 94*a* mesh with the external gear teeth 92*a* of the intermediate gear 92. In the illustrated embodiment, the ring gear 94 is formed as a separate part from the winch drum 14. However, it will be apparent to those skilled in the art from this disclosure that the ring gear 94 can be integrally formed about the inner periphery of the upper part 14*b* of the winch drum 14.

In the illustrated embodiment, the output gear set 44 has one intermediate gear 92. Also, in the illustrated embodiment, with the output gear set 44, the teeth numbers of the external gear teeth 90*a*, the external gear teeth 92*a*, and the internal gear teeth 94*a* are 24 T, 15 T, and 54 T, respectively. Furthermore, in the illustrated embodiment, the module of the external gear teeth 90*a* of the output sleeve 90, the external gear teeth 92*a* of the intermediate gear 92, and the internal gear teeth 94*a* of the ring gear 94 is "1.3," for example.

Referring now to FIGS. 2A, 2B, and 3 to 5, torque transmission paths of the sailboat winch 10 will be described in detail. As shown in FIGS. 2A and 2B, in the illustrated embodiment, the first gear set 40 and the output gear set 44 are arranged to establish a first torque transmission path P1 between the drive shaft 16 and the winch drum 14 as the drive shaft 16 rotates in the first rotational direction D1 about the rotational axis X0. Also, the second gear set 42 and the output gear set 44 are arranged to establish a second torque transmission path P2 between the drive shaft 16 and the winch drum 14 as the drive shaft 16 rotates in the second rotational direction D2 about the rotational axis X0.

More specifically, as shown in FIGS. 2A and 2B, the rotation of the drive shaft 16 (or winch handle 20) in the first rotational direction D1 is transmitted in the following first torque transmission path P1: the drive shaft 16→ the gear carrier 46→ the planet gears 56→ the ratchet gear 54→ the first one-way clutch 40*b*→ the output sleeve 90→ the intermediate gear 92→ the ring gear 94→ the winch drum 14. In particular, in response to the rotation of the winch handle 20 in the first rotational direction D1, the drive shaft 16 rotates together with the winch handle 20 in the first rotational direction D1 about the rotational axis X0. The rotation of the drive shaft 16 also rotates the gear carrier 46 in the first rotational direction D1 (the counterclockwise direction) about the rotational axis X0. When the gear carrier 46 rotates in the first rotational direction D1, the support axles 62 revolve in the first rotational direction D1 about the rotational axis X0 (see arrow R11 in FIG. 5). Since the support axles 62 rotatably support the planet gears 56 that mesh with the stationary ring gear 52, respectively, the revolutions of the support axles 62 in the first rotational direction D1 rotate the planet gears 56 in the second rotational direction D2 (the clockwise direction) about the center axes X1 of the support axles 62, respectively (see arrows R12 in FIG. 5). Furthermore, the rotations of the planet gears 56 in the second rotational direction D2 rotate the ratchet gear 54 in the first rotational direction D1 about the rotational axis X0 (see arrow R13 in FIG. 5). The rotation of the ratchet gear 54 in the first rotational direction D1 is transmitted to the output sleeve 90 via the first one-way clutch 40*b* to rotate the output sleeve 90 in the first rotational direction D1 about the rotational axis X0 (see arrow R18 in FIG. 3). This rotation of the output sleeve 90 rotates the intermediate gear 92 in the second rotational direction D2 about the center axis X4 of the support axle 96 (see arrows R19 in FIG. 3), which in turn rotates the ring gear 94 and the winch drum 14 in the single output rotational direction OD about the rotational axis X0 (see arrow R20 in FIG. 3).

In the illustrated embodiment, the first gear set 40 is configured to increase the rotational speed of the output sleeve 90 with respect to the rotational speed of the drive shaft 16. For example, in the illustrated embodiment, with the gear configurations of the first planetary gear 40*a*, the speed ratio of the rotational speed of the output sleeve 90 with respect to the rotational speed of the drive shaft 16 is about "6.07." Furthermore, the output gear set 44 is configured to decrease the rotational speed of the winch drum 14 with respect to the rotational speed of the output sleeve 90. For example, in the illustrated embodiment, with the gear configurations of the output gear set 44, the speed ratio of the rotational speed of the winch drum 14 with respect to the rotational speed of the output sleeve 90 is about "0.44." As a result, when the drive shaft 16 (or winch handle 20) is rotated in the first rotational direction D1, the total speed ratio of the output rotational speed of the winch drum 14 with respect to the input rotational speed of the drive shaft 16 becomes about "2.67" (=6.07×0.44). In other words, in the illustrated embodiment, the transmission mechanism 18 is configured to increase the output rotational speed of the winch drum 14 with respect to the input rotational speed of the drive shaft 16 as the drive shaft 16 rotates in the first rotational direction D1. With the sailboat winch 10, while the drive shaft 16 is rotated in the second rotational direction D2 about the rotational axis X0, the outer planet gears 76, the inner planet gears 78 and the ratchet gear 74 of the second gear set 42 also rotate, respectively. However, in this case, since the ratchet gear 74 rotates in the second rotational direction D2, the rotation of the ratchet gear 74 is prevented from being transmitted to the output gear set 44 by the operation of the second one-way clutch 42*b* of the second gear set 42.

On the other hand, as shown in FIGS. 2A and 2B, the rotation of the drive shaft 16 (or winch handle 20) in the second direction D2 is transmitted in the following second torque transmission path P2: the drive shaft 16→ the gear carrier 46→ the outer planet gears 76→ the inner planet gears 78→ the ratchet gear 74→ the second one-way clutch 42*b*→ the output sleeve 90→ the intermediate gear 92→ the ring gear 94→ the winch drum 14. In particular, in response to the forward rotation of the winch handle 20 in the second rotational direction D2, the drive shaft 16 rotates together with the winch handle 20 in the second rotational direction D2 about the rotational axis X0. The rotation of the drive shaft 16 also rotates the gear carrier 46 in the second rotational direction D2 about the rotational axis X0. When the gear carrier 46 rotates in the second rotational direction D2, the support axles 84 and 86 revolve in the second rotational direction D2 about the rotational axis X0 (see arrows R14 in FIG. 4). Since the support axles 84 rotatably support the outer planet gears 76 that mesh with the stationary ring gear 72, respectively, the revolutions of the support axles 84 in the second rotational direction D2 rotate the outer planet gears 76 in the first rotational direction D1 about the center axes X2 of the support axles 84, respectively (see arrows R15 in FIG. 4). Furthermore, the rotations of the outer planet gears 76 in the first rotational direction D1 rotate the inner planet gears 78 in the second rotational direction D2 about the center axes X3 of the support axles 86, respectively (see arrows R16 in FIG. 4). Then, the rotations of the inner planet gears 78 in the second rotational direction D2 rotates the ratchet gear 74 in the first rotational direction D1 about the rotational axis X0 (see arrow R17 in FIG. 4). The rotation of the ratchet gear 74 in the first rotational direction D1 is transmitted to the output sleeve 90 via the second one-way clutch 42*b* to rotate the output sleeve 90 in the first rotational direction D1 about the rotational axis X0 (see arrow R18 in FIG. 3). This rotation of the output sleeve 90 rotates the intermediate gear 92 in the second rotational direction D1 about the center axis X4 of the support axle 96 (see arrows R19 in FIG. 3), which in turn rotates the ring gear 94 and the winch drum 14 in the single output rotational direction OD about the rotational axis X0 (see arrow R20 in FIG. 3).

In the illustrated embodiment, the second gear set 42 is configured to decrease the rotational speed of the output sleeve 90 with respect to the rotational speed of the drive shaft 16. For example, in the illustrated embodiment, with the gear configurations of the second planetary gear 42*a*, the speed ratio of the rotational speed of the output sleeve 90 with respect to the rotational speed of the drive shaft 16 is about "0.29." Furthermore, the output gear set 44 is configured to decrease the rotational speed of the winch drum 14 with respect to the rotational speed of the output sleeve 90. For example, in the illustrated embodiment, with the gear configurations of the output gear set 44, the speed ratio of the rotational speed of the winch drum 14 with respect to the rotational speed of the output sleeve 90 is about "0.44." As a result, when the drive shaft 16 (or winch handle 20) is rotated in the second rotational direction D2, the total speed ratio of the output rotational speed of the winch drum 14 with respect to the input rotational speed of the drive shaft 16 becomes about "0.13" (=0.29×0.44). In other words, in the illustrated embodiment, the transmission mechanism 18 is configured to decrease the output rotational speed of the winch drum 14 with respect to the input rotational speed of the drive shaft 16 as the drive shaft 16 rotates in the second rotational direction D2, which is opposite the first rotational direction D1. With the sailboat winch 10, while the drive shaft 16 is rotated in the second rotational direction D2 about the rotational axis X0, the planet gears 56 and the ratchet gear 54 of the first gear set 40 also rotate, respectively. However, in this case, since the ratchet gear 54 rotates in the second rotational direction D2, the rotation of the ratchet gear 54 is prevented from being transmitted to the output gear set 44 by the operation of the first one-way clutch 40*b* of the first gear set 40.

In the illustrated embodiment, with the sailboat winch 10, when loading the sailboat winch 10, the tail of the line does not need to be manually pulled to temporarily apply the tension to the line. Instead of temporality applying the tension to the line by manually pulling the tail of the line, the winch handle 20 is rotated in the first rotational direction D1 after the line is manually placed about a couple of turns around the winch drum 14. This operation of the winch handle 20 rotates the winch drum 14 in the second rotational direction D2 faster than the rotational speed of the winch handle 20. As a result, the tension of the line can be easily increased in a short time. Furthermore, when the tension of the line is increased, then the winch handle 20 is rotated in the second rotational direction D2, which generates more torque of the winch drum 14 to draw the line. Thus, with the sailboat winch 10, the desired tension of the line can be adequately and promptly obtained. Also, the workload for manually drawing the line to temporarily apply the tension can be reduced.

In the illustrated embodiment, the gear configurations of the gears, such as the diameters or the teeth numbers of the gears are provided for illustration only, and can be different as needed and/or desired. In particular, as long as the transmission mechanism 18 is configured to increase the output rotational speed of the winch drum 14 with respect to the input rotational speed of the drive shaft 16 as the drive shaft 16 rotates in the first rotational direction D1, the gear configurations of the gears, such as the first gear set 40 and the output gear set 44, can be different. For example, in the illustrated embodiment, the total speed ratio of the output rotational speed of the winch drum 14 with respect to the input rotational speed of the drive shaft 16 becomes about "2.67" when the drive shaft 16 is rotated in the first rotational direction D1. However, the total speed ratio can be set to different value by changing the gear configurations. For example, the transmission mechanism 18 can be configured such that the total speed ratio is more than "1.00," such as a value between 1.00 and 3.00, between 2.00 and 3.00, or between 2.50 and 3.00, for example, when the drive shaft 16 is rotated in the first rotational direction D1. Furthermore, as long as the transmission mechanism 18 is configured to decrease the output rotational speed of the winch drum 14 with respect to the input rotational speed of the drive shaft 16 as the drive shaft 16 rotates in the second rotational direction D2, the gear configurations of the gears, such as the second gear set 42 and the output gear set 44, can be different. For example, in the illustrated embodiment, the total speed ratio of the output rotational speed of the winch drum 14 with respect to the input rotational speed of the drive shaft 16 becomes about "0.13" when the drive shaft 16 is rotated in the second rotational direction D2. However, the total speed ratio can be set to different value by changing the gear configurations. For example, the transmission mechanism 18 can be configured such that the total speed ratio is less than "1.00," such as a value between 0.10 and 1.00, or between 0.10 and 0.50, for example, when the drive shaft 16 is rotated in the second rotational direction D2.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "below", "upward", "downward", "top". "bottom", "side", "vertical", "horizontal", "perpendicular" and "transverse" as well as any other similar directional terms refer to those directions of a sailboat in an upright cruising position. Accordingly, these directional terms, as utilized to describe the sailboat winch should be interpreted relative to a sailboat in an upright cruising position on a horizontal surface.

Also it will be understood that although the terms "first" and "second" may be used herein to describe various components these components should not be limited by these terms. These terms are only used to distinguish one component from another. Thus, for example, a first component discussed above could be termed a second component and vice-a-versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only a selected embodiment has been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiment according to the present invention are provided for illustration only, and not for the purpose of limiting the invention as defined by the appended claims and their equivalents.

What is claimed is:

1. A sailboat winch comprising:

a support configured to be mounted to a sailboat;

a winch drum rotatable with respect to the support;

a drive shaft rotatable with respect to the support and the winch drum; and a transmission mechanism operatively disposed between the drive shaft and the winch drum to transmit rotation from the drive shaft to the winch drum in a single output rotational direction, the transmission mechanism being configured to increase an output rotational speed of the winch drum with respect to an input rotational speed of the drive shaft as the drive shaft rotates in a first rotational direction, the transmission mechanism being further configured to decrease the output rotational speed of the winch drum with respect to the input rotational speed of the drive shaft as the drive shaft rotates in a second rotational direction, which is opposite the first rotational direction, and the transmission mechanism including a first gear set with a first planetary gear and a first one-way clutch, a second gear set with a second planetary gear and a second one-way clutch, and an output gear set operatively coupled to the first and second planetary gears via the first and second one-way clutches, respectively, the output gear set including a ring fixedly coupled to the winch drum, the ring gear transmitting rotation from the drive shaft to the winch drum as the drive shaft rotates in the first direction and as the drive shaft rotates in the second direction.

2. The sailboat winch according to claim 1, wherein the first gear set and the output gear set are arranged to establish a first torque transmission path between the drive shaft and the winch drum as the drive shaft rotates in the first rotational direction, and the second gear set and the output gear set are arranged to establish a second torque transmission path between the drive shaft and the winch drum as the drive shaft rotates in the second rotational direction.

3. The sailboat winch according to claim 1, wherein the winch drum and the drive shaft are concentrically arranged relative to each other.

4. The sailboat winch according to claim 3, wherein the first rotational direction of the drive shaft is opposite the output rotational direction of the winch drum.

5. The sailboat winch according to claim 1, wherein the drive shaft has a crank attachment structure that is configured to receive a crank handle for manual rotation of the drive shaft.

* * * * *